US007899383B2

(12) United States Patent
Shintani et al.

(10) Patent No.: US 7,899,383 B2
(45) Date of Patent: Mar. 1, 2011

(54) LUBRICATING DEVICE, LUBRICANT APPLICATOR, AND PRIMING AGENT USED THEREWITH

(75) Inventors: Takeshi Shintani, Kawasaki (JP); Takaya Muraishi, Kawasaki (JP); Satoshi Hatori, Yokohama (JP); Yasushi Akiba, Yokohama (JP); Akio Kosuge, Yokohama (JP); Kaoru Yoshino, Tokyo (JP)

(73) Assignee: Ricoh Company Limited, Tokyo (JP)

( * ) Notice: Subject to any disclaimer, the term of this patent is extended or adjusted under 35 U.S.C. 154(b) by 107 days.

(21) Appl. No.: 12/253,581

(22) Filed: Oct. 17, 2008

(65) Prior Publication Data

US 2009/0103944 A1 Apr. 23, 2009

(30) Foreign Application Priority Data

Oct. 19, 2007 (JP) ..... 2007-272190

(51) Int. Cl.
*G03G 21/00* (2006.01)

(52) U.S. Cl. ..... 399/346; 399/350

(58) Field of Classification Search ..... 399/71, 399/123, 343, 346, 352, 353, 350
See application file for complete search history.

(56) References Cited

U.S. PATENT DOCUMENTS

| | | | |
|---|---|---|---|
| 5,878,317 | A | 3/1999 | Masuda et al. |
| 6,505,022 | B2 | 1/2003 | Kosuge et al. |
| 6,560,438 | B2 | 5/2003 | Kosuge |
| 6,567,637 | B2 | 5/2003 | Yanagisawa et al. |
| 6,577,842 | B2 | 6/2003 | Akiba et al. |
| 6,768,879 | B2 | 7/2004 | Kosuge |
| 6,868,252 | B2 | 3/2005 | Akiba |
| 7,050,741 | B2 | 5/2006 | Koike et al. |
| 7,062,194 | B2 | 6/2006 | Yanagida et al. |
| 7,065,316 | B2 | 6/2006 | Yanagida et al. |
| 7,085,528 | B2 | 8/2006 | Shintani et al. |
| 7,110,696 | B2 | 9/2006 | Murakami et al. |
| 7,130,564 | B2 | 10/2006 | Murakami et al. |
| 7,139,504 | B2 | 11/2006 | Yanagida et al. |
| 7,149,465 | B2 | 12/2006 | Amemiya et al. |
| 7,218,877 | B2 | 5/2007 | Yanagida et al. |
| 7,228,099 | B2 | 6/2007 | Shintani et al. |
| 7,263,308 | B2 | 8/2007 | Harada et al. |
| 7,266,324 | B2 | 9/2007 | Yanagida et al. |
| 7,272,354 | B2 | 9/2007 | Murakami et al. |

(Continued)

FOREIGN PATENT DOCUMENTS

| | | |
|---|---|---|
| JP | 2006-113528 | 4/2006 |

*Primary Examiner*—Hoang Ngo
(74) *Attorney, Agent, or Firm*—Oblon, Spivak, McClelland, Maier & Neustadt, L.L.P.

(57) ABSTRACT

A lubricating device operable to lubricate a moving imaging surface subsequent to removal of residual toner by a cleaning device includes a lubricant applicator, a metering blade, and a priming agent. The lubricant applicator is located downstream of the cleaning device in a direction of movement of the imaging surface, and applies lubricant to the imaging surface. The metering blade is located downstream of the lubricant applicator in the direction of movement of the imaging surface, and spreads the applied lubricant into a thin layer by directly contacting the imaging surface. The priming agent is prepared by mixing a lubricant and a powder, and provided, prior to initial operation, on the lubricant applicator for application to the imaging surface upon startup.

19 Claims, 7 Drawing Sheets

U.S. PATENT DOCUMENTS

| | | | | |
|---|---|---|---|---|
| 7,289,748 | B2 | 10/2007 | Yanagisawa et al. | |
| 7,292,816 | B2 | 11/2007 | Ojimi et al. | |
| 7,295,796 | B1 | 11/2007 | Murakami et al. | |
| 7,302,197 | B2 | 11/2007 | Kosuge | |
| 7,346,308 | B2 * | 3/2008 | Harada | 399/353 |
| 7,386,257 | B2 | 6/2008 | Koike et al. | |
| 7,430,377 | B2 | 9/2008 | Koike et al. | |
| 2005/0164108 | A1 | 7/2005 | Murakami et al. | |
| 2005/0191574 | A1 | 9/2005 | Koike et al. | |
| 2005/0232665 | A1 | 10/2005 | Toshio et al. | |
| 2007/0009293 | A1 | 1/2007 | Akiba et al. | |
| 2007/0036595 | A1 | 2/2007 | Amemiya et al. | |
| 2007/0071525 | A1 | 3/2007 | Yoshino et al. | |
| 2007/0154246 | A1 | 7/2007 | Shintani et al. | |
| 2007/0183824 | A1 * | 8/2007 | Suda et al. | 399/346 |
| 2008/0013986 | A1 | 1/2008 | Kosuge | |
| 2008/0069614 | A1 | 3/2008 | Shintani et al. | |

* cited by examiner

LUBRICATING DEVICE, LUBRICANT APPLICATOR, AND PRIMING AGENT USED THEREWITH

CROSS-REFERENCE TO RELATED APPLICATIONS

The present patent application claims priority pursuant to 35 U.S.C. §119 from Japanese Patent Application No. 2007-272190 filed on Oct. 19, 2007, the contents of which are hereby incorporated by reference herein in their entirety.

BACKGROUND OF THE INVENTION

1. Field of the Invention

The present invention relates to a lubricating device, a lubricant applicator, and a priming agent used therewith, and more particularly, to a lubrication system incorporated in electrophotographic image forming apparatuses, such as photocopiers, printers, facsimiles, or multifunctional machines having image forming capabilities, which includes a lubricant applicator to apply lubricant to a movable imaging surface, such as a photoconductive drum, a photoconductive belt, an intermediate transfer belt, or the like, and a priming agent used with the lubricant applicator.

2. Discussion of the Background

In electrophotographic image forming apparatuses, such as photocopiers, printers, facsimiles, or multifunctional machines, electrophotographic toner images are transferred from one surface to another, such as moving surfaces of a photoconductive drum or photoconductive belt, an intermediate transfer belt, or the like. Typically, such a transfer process is followed by cleaning of the imaging surface to remove residual toner and other matter including toner additives and paper dust in preparation for the next imaging cycle. One example of such cleaning process employs a cleaning blade to scrape off adhering materials with an edge held in frictional contact with a moving imaging surface.

Such a cleaning device occasionally fails to completely remove residual particles, where the operative edge of the cleaning blade is abraded or worn away due to continuous frictional contact with the imaging surface, making a gap that allows some material to bypass the cleaning process. Cleaning failure also occurs where toner particles used are small in size and/or round in shape, which tend to flow into narrow spaces between the cleaning blade and the imaging surface and eventually escape away from the cleaning device. In particular, a cleaning defect called "filming" occurs when toner residue including toner additives and paper dust passing through the cleaning gap builds up to form a layer adhering to the imaging surface.

To prevent such cleaning deficiencies, some electrophotographic imaging apparatuses lubricate an imaging surface used in contact with a cleaning blade. The lubrication process reduces frictional resistance between the imaging surface and the blade edge to prevent abrasion and wear of the both, while allowing residual materials to easily slip over the imaging surface. This enables the cleaning device to work properly and maintains a defect-free condition of the imaging surface over time.

For example, one conventional lubricating method uses a lubricant applicator or brush roller that supplies lubricant to an imaging surface cleaned by a cleaning blade. The brush roller is in sliding contact with the imaging surface and with a solid mass of lubricant pressed thereagainst by a spring, respectively. The lubricating device also includes a metering blade contacting the imaging surface downstream of the brush roller. In use, the brush roller rotates in a given direction to pick up lubricant in small portions from the solid mass and apply it to the imaging surface, followed by the metering blade spreading the applied lubricant into a thin layer of uniform thickness or depth over the imaging surface.

According to this method, the lubricating device is located separate and downstream from the cleaning blade, and lubricates the imaging surface subsequent to removal of residual toner by the cleaning process. The separate configuration enables the lubricant applicator to supply a constant amount of lubricant to the imaging surface irrespective of the amount of toner entering the cleaning process, which provides stable lubrication compared to a configuration where a lubricating device is provided as an internal and integral part of a cleaning device.

One problem with the lubricating method described above arises when a brand-new lubricating device is operated for the first time after installation. During initial operation, the lubricant applicator has little if any lubricant immediately after startup or until it begins to receive constant amounts of lubricant from the lubricant source. The result is insufficient lubricant supplied where the imaging surface contacts the metering blade.

Such insufficient lubrication often causes the edge or tip of the metering blade to fracture due to high friction on the imaging surface. Fractures in the blade edge, once created, make a gap between the metering blade and the imaging surface through which unregulated amounts of lubricant leak to contaminate areas downstream of the metering blade. These contaminants interfere with charging and thus impair uniformity of images produced therethrough.

Moreover, the blade edge can suffer fracture repeatedly whenever an existing device is worn out and requires installation of a new one. The risk of damaging the blade edge increases particularly when the metering blade has its operative edge pointing in a direction opposite to the direction of movement of the imaging surface for effectively spreading lubricant over the imaging surface.

To deal with initial lack of lubrication on an imaging surface, one conventional cleaning method proposes to coating a brand-new cleaning brush with a given amount of toner preparatory to installation in an imaging system. The preparatory coating of toner is designed to prevent a cleaning blade from bending back due to high friction on an imaging surface used in conjunction with the cleaning brush.

Unfortunately, application of such a conventional method does not provide a satisfactory solution to the problem with the lubricating device. Recent experiments have confirmed that the preparatory coating of toner on an imaging surface, a lubricant applicator, and/or a metering blade in brand-new, unused condition does not effectively reduce frictional resistance between the metering blade and the imaging surface in the lubricating device.

It has been also confirmed that the conventional method remains insufficient even when modified to use lubricant instead of toner as the preparatory coating. Although the preparatory coating of lubricant does reduce frictional resistance, the lubricating effect is temporary and dissipates in a short time after installation as the lubricant quickly passes through, eventually causing fracturing of the metering blade.

Hence, it is advantageous to have a lubrication system that can provide stable and constant lubrication on an imaging surface upon initial startup after installation.

SUMMARY OF THE INVENTION

Exemplary aspects of the present invention are put forward in view of the above-described circumstances, and provide a novel lubricating device that applies lubricant to a movable imaging surface.

Other exemplary aspects of the present invention provide a novel lubricant applicator used to apply lubricant to a movable imaging surface.

Still other exemplary aspects of the present invention provide a novel priming agent for use with a lubricant applicator to apply lubricant to a movable imaging surface.

In one exemplary embodiment, the novel lubricating device operable to lubricate a moving imaging surface subsequent to removal of residual toner by a cleaning device includes a lubricant applicator, a metering blade, and a priming agent. The lubricant applicator is located downstream of the cleaning device in a direction of movement of the imaging surface, and applies lubricant to the imaging surface. The metering blade is located downstream of the lubricant applicator in the direction of movement of the imaging surface, and spreads the applied lubricant into a thin layer by directly contacting the imaging surface. The priming agent is prepared by mixing a lubricant and a powder, and provided, prior to initial operation, on the lubricant applicator for application to the imaging surface upon startup.

In one exemplary embodiment, the lubricant applicator operable to apply lubricant to a moving imaging surface downstream of a cleaning device and upstream of a metering blade in a direction of movement of the imaging surface includes a priming agent. The cleaning device removes residual toner from the imaging surface. The metering blade spreads the applied lubricant into a thin layer by directly contacting the imaging surface. The priming agent is prepared by mixing a lubricant and a powder, and provided, prior to initial operation, on the lubricant applicator for application to the imaging surface upon startup.

In one exemplary embodiment, the priming agent is used with a lubricant applicator. The lubricant applicator is operable to apply lubricant onto a movable imaging surface downstream of a cleaning device and upstream of a metering blade in a direction of movement of the imaging surface. The cleaning device removes residual toner from the imaging surface. The metering blade spreads the applied lubricant into a thin layer by directly contacting the imaging surface. The priming agent is prepared by mixing a lubricant and a powder, and provided, prior to initial operation, on the lubricant applicator for application to the imaging surface upon startup.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
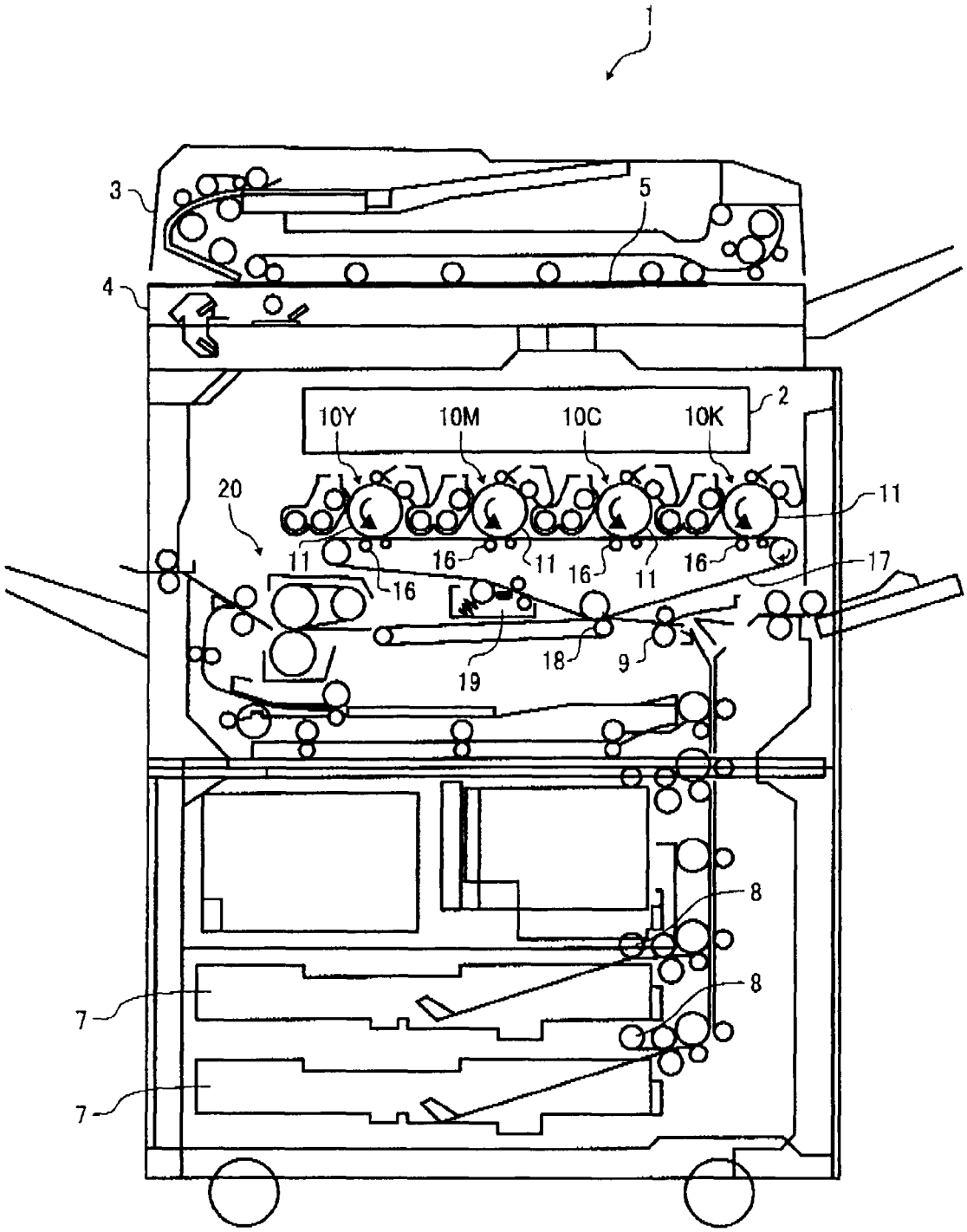
FIG. 1 schematically illustrates an image forming apparatus including a lubrication system according to an embodiment of the invention.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1, in which a lubrication system according to this patent specification finds advantageous application.

As shown in FIG. 1, the image forming apparatus 1 is a tandem color printer with four process cartridges, generally indicated by the reference numeral 10, each having a photoconductive drum 11 to form an electrophotographic image with toner of a particular color, as designated by the suffix letters, "Y" for yellow, "M" for magenta, "C" for cyan, and "K" for black. The term "process cartridge", as used herein, refers to a modular unit in which a photoconductor and at least one of a charging device, a developing device, and a photoconductor cleaner are integrated into a single unit for detachable attachment to an image forming apparatus.

The image forming apparatus 1 also includes a write scanner 2, a document feeder 3, a read scanner 4, a platen glass 5, sheet feeders 7 with feed rollers 8, a pair of registration rollers 9, multiple primary transfer rollers 16, an intermediate transfer belt 17, a secondary transfer roller 18, a belt cleaner 19, and an image fuser 20.

In multicolor image formation, first, an original document to be reproduced is loaded in the document feeder 3 and transported face down onto the platen glass 5 by a feed roller. The read scanner 4 then optically scans the face of the original with a lamp, and light reflected off the original image is focused onto a color sensor through a series of reflection mirrors and lenses. The color sensor separates the incoming light into primary colors, red, green, and blue ("RGB"), and converts each color component into a separate electrical signal. The RGB image data thus obtained is subjected to several processes, such as color conversion, color calibration, spatial frequency correction, etc., through which are generated image signals for the four primary colors used in the printing process, yellow, magenta, cyan, and black ("YMCK").

The YMCK image data is then transmitted to the write scanner 2. In the write scanner 2, four light sources output separate laser beams L, not shown, in conformity with the incoming image signals. Each laser beam L, reflected off facets of a spinning polygon mirror, travels along a specific light path toward an associated one of the process cartridges 10. That is, starting from the left in the drawing, the process cartridge 10Y receives one carrying the yellow component, the process cartridge 10M for one carrying the magenta component, the process cartridge 10C for one carrying the cyan component, and the process cartridge 10K for one carrying the black component.

In each process cartridge 10, the photoconductive drum 11 rotates in a direction indicated by an arrow (counterclockwise in the drawing) so as to forward an outer photoconductive surface to a series of imaging processes as described later with reference to FIGS. 2A and 2B. Each laser beam L entering the process cartridge 10 exposes the photoconductive surface to generate an electrostatic latent image thereon. The latent image is developed into visible form using toner and reaches a primary transfer nip defined between the intermediate transfer belt 17 and the primary transfer roller 16.

At the primary transfer nip, the toner image is transferred from the photoconductive drum 11 to an outer surface of the intermediate transfer belt 17, where the primary transfer roller 16 applies a bias voltage to the opposite side of the intermediate transfer belt 17. Such transfer process occurs sequentially at the four transfer nips as the intermediate transfer belt 17 travels clockwise in the drawing, so that the toner images of different colors are superimposed one atop another to form a multicolor image on the belt surface. The intermediate transfer belt 17 further travels to advance the multicolor image to a secondary transfer nip defined between the intermediate transfer belt 17 and the secondary transfer roller 18.

During such scanning and imaging processes, the feed roller 8 feeds a recording sheet from the sheet feeder 7 to a guide path, along which the fed sheet travels to reach the pair of registration rollers 9. The registration rollers 9 holds the recording sheet and advances it to the secondary transfer nip in synch with the movement of the intermediate transfer belt 17, so that the multicolor image is transferred from the belt surface onto the recording sheet.

After passing the secondary transfer nip, the outer surface of the intermediate transfer belt 17 enters a belt cleaner 19, which removes and collects residual toner before completion of one belt rotation. At the same time, the recording sheet bearing the powder toner image thereon is introduced into the image fuser 20 by a transport belt. The image fuser 20 fixes the multicolor image into place at a fixing nip defined between a fixing belt and a pressure roller.

Thereafter, the recording sheet is forwarded outside the apparatus by output rollers, which completes one operation cycle of the image forming apparatus 1.

The multicolor image formation described above is performed at high speeds, where components, such as the photoconductive drum 11, the primary transfer belt 17, and the rollers conveying the recording sheet, are driven at linear speeds ranging from approximately 280 to approximately 350 mm per second.

Figure 2A:
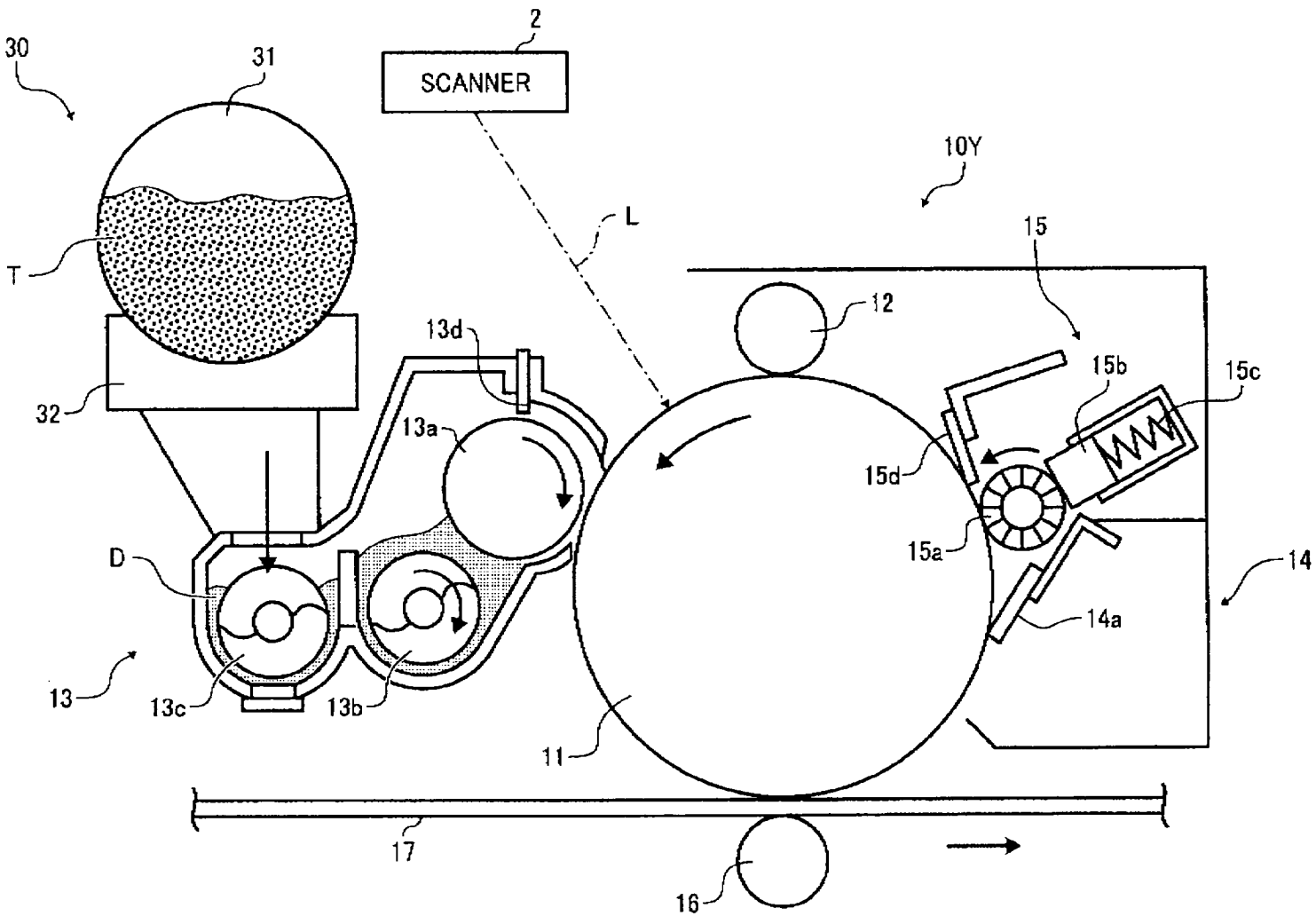
FIGS. 2A and 2B schematically illustrate a process cartridge incorporating the lubrication system.
Figure 2B:
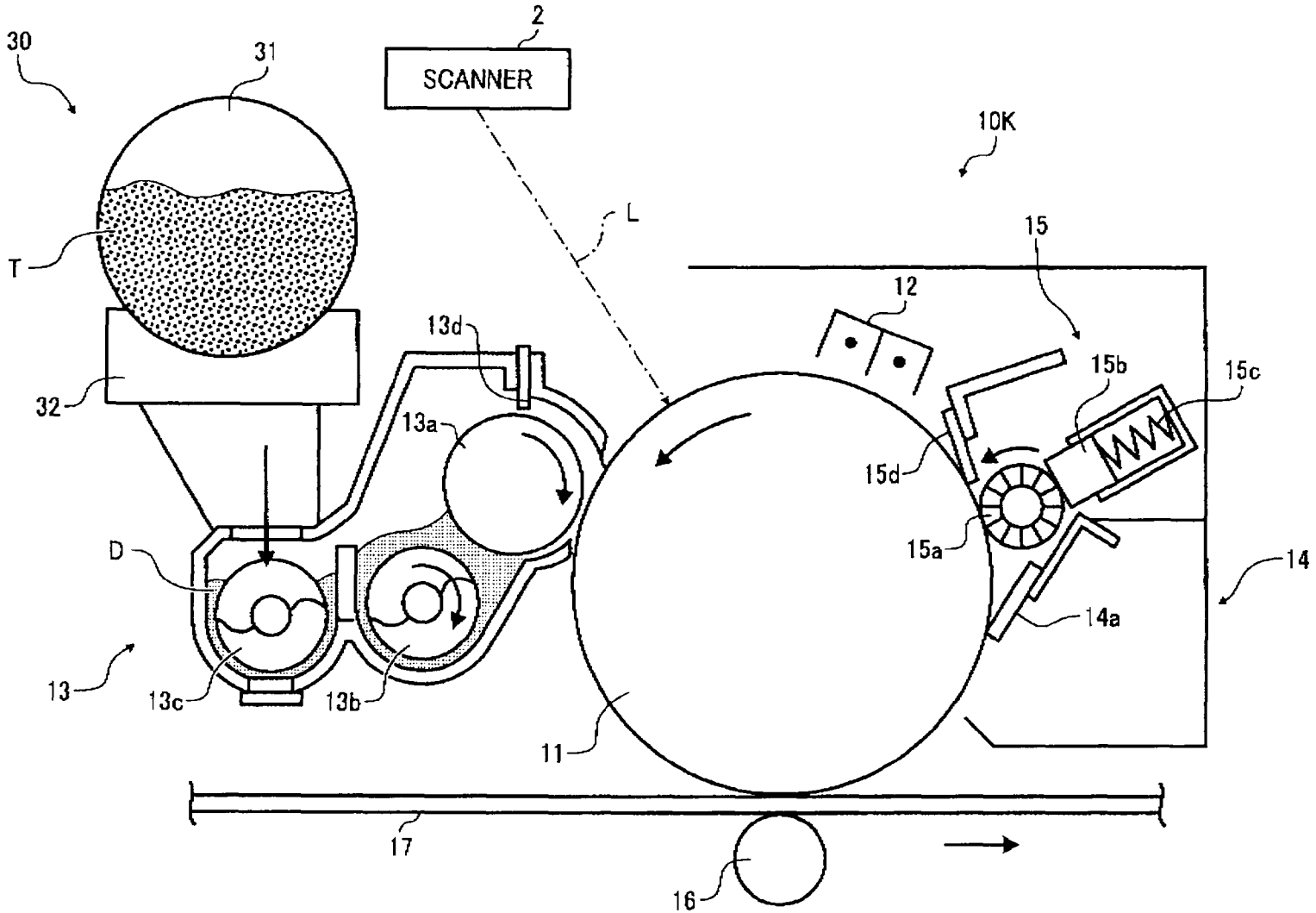

FIGS. 2A and 2B schematically illustrate the process cartridge 10 incorporating the lubrication system according to this patent specification.

In the embodiment described herein, the process cartridges 10Y, 10M, and 10C are substantially identical in basic configuration and operation, except for the color of toner used in the development process. As for the process cartridge 10K, the configuration differs from that for the others in the type of charging device in addition to the toner color. Hence, the following description focuses primarily on the configuration of the process cartridge 10Y, which will suffice as a general description of the imaging system used in the image forming apparatus 1.

With reference to FIG. 2A, the process cartridge 10Y includes the photoconductive drum 11, a charging device 12, a developing device 13, a cleaning device 14, and a lubricating device 15, all of which are integrated into a modular unit for detachable attachment to the image forming apparatus 1. In addition, the developing device 13 is connected to a toner supply 30 disposed in the image forming apparatus 1.

In the process cartridge 10Y, the photoconductive drum 11 is a negatively chargeable organic photoconductor, including a conductive cylindrical substrate onto which an insulative primer layer, a photoconductive layer formed of a charge generating part and a charge transport part, and a protective top layer are sequentially deposited.

As mentioned, the process cartridge 10 operates as the photoconductive drum 11 rotates counterclockwise in the drawing to forward its photoconductive surface through a series of imaging processes, including charging, exposure, development, transfer, cleaning, lubrication, and discharging processes.

During operation, first, the charging device 12 uniformly charges the photoconductive surface to a given electrostatic potential.

In the non-black process cartridge 10Y, the charging device 12 is configured as a charge roller. The charge roller is formed of a conductive metal core coated with a moderately resistive layer of a resilient material. The charge roller may be held either in or out of contact with the photoconductive drum 11, and imparts uniform charge to the photoconductive surface when supplied with a bias voltage generated by superimposing an alternate current voltage on a direct current voltage.

In the black process cartridge 10K, the charging device 12 is provided as a corona charger (see FIG. 2B). The corona charger has charge wires located in the proximity of the photoconductive drum 11, which impart uniform charge to the photoconductive surface when supplied with a direct current voltage.

After the charging process, the photoconductive surface is exposed to the laser beam L emitted from the write scanner 2 as described with reference to FIG. 1. The photoconductive surface thus having an electrostatic latent image formed thereon by exposure to the laser beam L is advanced to reach the developing device 13.

The developing device 13 includes a developer roller 13*a* formed of a stationary magnet located inside a rotatable sleeve to form a magnetic field with multiple poles around the sleeve, first and second screw conveyors 13*b* and 13*c* located side-by-side with a partition therebetween, and a doctor blade 13*d* held against the developer roller 13*a*. The developing device 13 holds a two-component developer D formed of toner particles T and carrier particles C, and receives new toner from the toner supply 30 via a supply port, not shown.

The toner T used in the developing device 13 has a volume average particle size of approximately 5.8±0.5 μm and a cohesion of approximately 10% or lower. In this patent specification, "volume average particle size" of powder material is measured using a particle size analyzer Model SD2000, available from Hosokawa Micron Corp., and "cohesion" of powder material is measured using a powder characteristics tester Model PT-N, available from Hosokawa Micron Corp.

Specifically, the PT-N tester has a set of three sieves stacked vertically in descending order of aperture size, i.e., one with a sieve opening of 22 μm at the bottom, one with a sieve opening of 45 μm in the middle, and one with a sieve opening of 75 μm at the top. In cohesion measurement, a sample of 2 grams of material is loaded onto the uppermost sieve, and the three sieves are vibrated at an amplitude of 1 millimeter for 30 seconds. Cohesion is determined from the amount of material remaining on each sieve after vibration in accordance with the following formula:

$$\text{Cohesion}=(Wa+0.6Wb+0.2Wc)/W*100$$

where "Wa" is the weight of material remaining on the uppermost sieve, "Wb" is the weight of material remaining on the middle sieve, "Wc" is the weight of material remaining on the lower most sieve, and "W" is the total weight of the sample loaded for analysis. Powder cohesion obtained by the above formula is inversely related to flowability of the material, so that the lower the powder cohesion, the higher the powder flowability.

With further reference to FIG. 2A, the toner supply 30 includes a replaceable toner bottle 31 holding fresh toner and a toner hopper 32 connecting the toner bottle 31 to the developing device 13. The toner bottle 31 is cylindrical in shape with a spiral groove on its peripheral surface, and dispenses toner when rotated by the toner hopper 32. The amount of toner supplied is controlled by the amount of toner consumed in the developing device 13, as detected by an optical sensor measuring light reflected off the photoconductive surface, or as indicated by a magnetic sensor disposed within the developing device 13 below the second screw conveyor 13*c*.

In the developing device 13, the first and second screw conveyors 13*b* and 13*c* rotate to mix and agitate the developer D with new toner while circulating the mixed material in a direction that is perpendicular to the sheet of paper on which the FIG. is drawn. As the agitation by the screw conveyors 13*b* and 13*c* generates triboelectricity in the mixed material, the toner particles T are electrostatically attracted to the carrier particles C within the developer D.

Downstream of the mixing process, the developer roller 13*a* attracts the carrier C carrying the toner T with the magnetic field formed therearound. A layer of the developer D thus formed on the rotating sleeve is trimmed to a desired thickness by passing through a gap defined between the doctor blade 13*d* and the developer roller 13*a*. When the developer layer meets the electrostatic latent image on the photoconductive drum 11, the toner T transfers from one surface to another based on an electric field or potential difference between the electrostatic latent image and a bias voltage applied to the developer roller 13*a*, developing a toner image on the photoconductive surface.

Then, the toner image is transferred from the photoconductive drum 11 to the intermediate transfer belt 17 at the primary transfer nip, where a certain amount of toner particles is left behind on the photoconductive surface while most of the particles move to the belt surface.

After the transfer process, the cleaning device 14 cleans the photoconductive surface of residual particles, including untransferred toner, paper dust from recording sheets, chemicals generated by charging the photoconductive surface, toner additives, and the like.

The cleaning device 14 includes a cleaning blade 14*a* formed of an elastic material such as urethane rubber. The cleaning blade 14*a* has an operative end held against the photoconductive surface at a given angle and a given pressure and pointing the direction opposite the rotational direction of the photoconductive drum 11. Thus, the cleaning blade 14*a* scrapes off and collects residue from the photoconductive surface into the cleaning device 14 as the photoconductive drum 11 rotates.

Thereafter, the photoconductive surface is passed to the lubricating device 15 and a discharging device, not shown, which serve to prepare the photoconductive surface for the next imaging cycle.

The lubricating device 15 includes a lubricant applicator or brush roller 15*a*, a solid mass of lubricant 15*b*, a spring 15*c*, and a metering blade 15*d*. The lubricating device 15 is located downstream from the cleaning device 14 and upstream of the charging device 12 along the rotational direction of the photoconductive drum 11, and supplies lubricant to the photoconductive surface after removal of residual toner by the cleaning process.

Figure 3A:
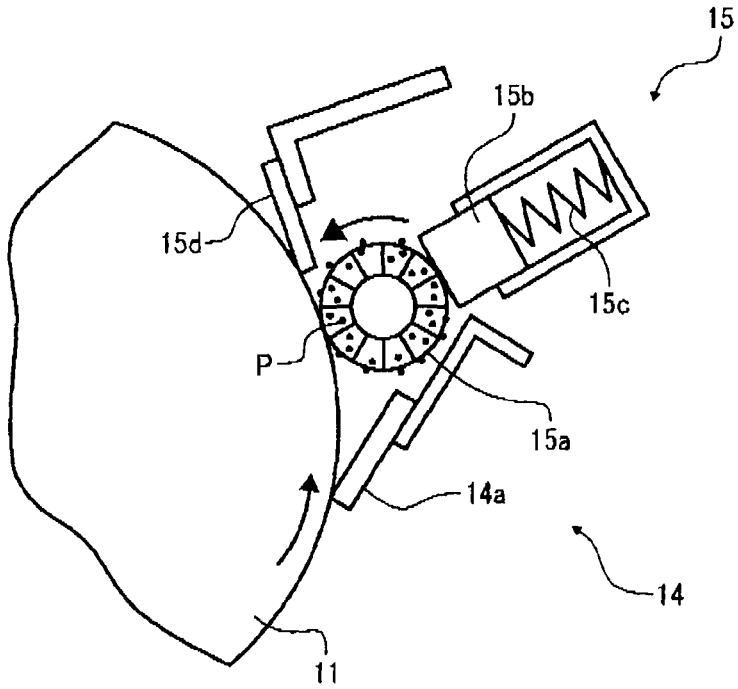
FIG. 3A schematically illustrates the lubrication system in use.
Figure 3B:
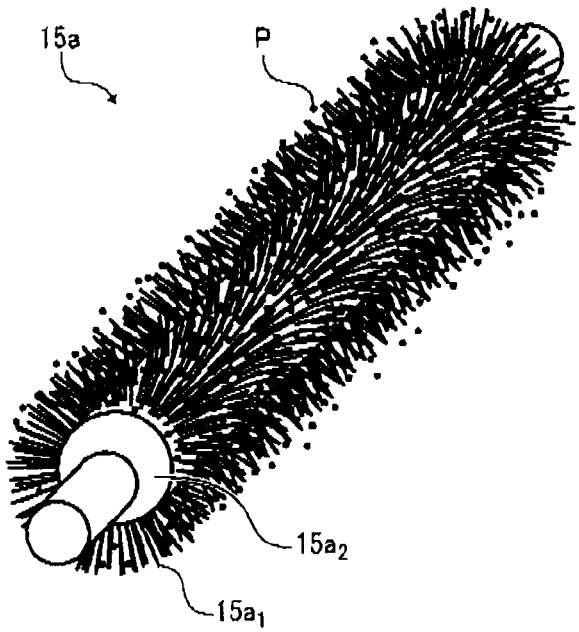
FIG. 3B schematically illustrates a lubricant applicator incorporated in the lubrication system of FIG. 3A.
Figure 3C:
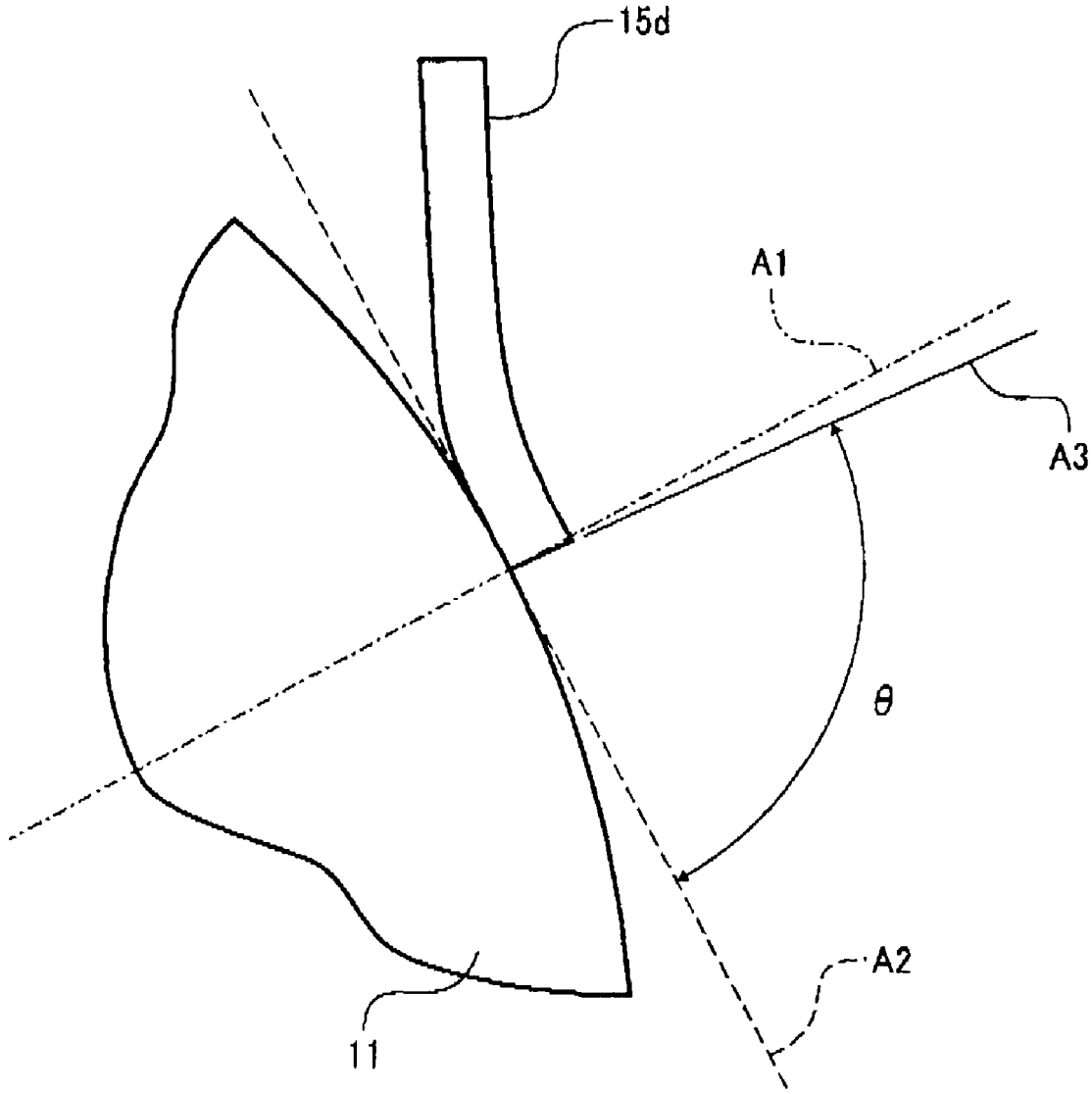
FIG. 3C schematically illustrates a metering blade incorporated in the lubrication system of FIG. 3A.

Referring to FIGS. 3A through 3C, the lubrication system according to this patent specification is described in detail.

As shown in FIG. 3A, in the lubricating device 15, the brush roller 15*a* has a bristled outer surface contacting the solid lubricant 15*b* at one side and the photoconductive drum 11 at another side substantially opposite the side that contacts the solid lubricant 15*b*. The spring 15*c* biases the solid lubricant 15*b* against the brush roller 15*a* to establish consistent contact therebetween. The metering blade 15*d* is located downstream from the cleaning blade 14*a* and the brush roller 15*a* along the rotational direction of the photoconductive drum 11. The metering blade 15*d* is a plate made of an elastic material such as urethane rubber, with an operative end held in contact with the photoconductive surface and pointing in the direction opposite the rotational direction of the photoconductive drum 11.

In use, both the brush roller 15*a* as well as the photoconductive drum 11 rotate counterclockwise in the drawing, so that the bristled surface of the brush roller 15*a* moves in a direction opposite to that of the photoconductive surface where the two surfaces meet in sliding contact with each other. Thus, the bristled surface of the brush roller 15*a* slides over the respective surfaces of the photoconductive drum 11 and the solid lubricant 15*b*, removing portions of lubricant from the lubricant mass 15*b* and placing supplies of lubricant onto the photoconductive drum 11.

Downstream of the brush roller 15*a*, the metering blade 15*d* meters a correct amount of lubricant placed on the rotating photoconductive drum 11. The lubricant supplied to the photoconductive surface is initially in a powdery and uneven state, and as such is not yet fully effective. The metering action spreads the lubricant into a thin uniform layer, providing uniform and effective lubrication over the photoconductive surface. In the present embodiment, the amount of lubricant supplied to the photoconductive surface is set in the range of approximately 0.00015 to approximately 0.00047 $mg/mm^2$.

In the present embodiment, the solid lubricant 15*b* is configured as zinc stearate blended with suitable additives. As is well known, zinc stearate powder has a crystalline lattice or lamellar structure made from self-assembly of amphiphilic molecules, which can be easily sheared into constituent layers and allows relative motion between the lamellae. Therefore, even when applied in small amounts, the zinc stearate lubricant can form a thin uniform layer owing to its lamellar structure to provide effective lubrication over the photoconductive surface.

Instead of zinc stearate, the material of the lubricant 15*b* may be any material that has sufficient lubricating performance and causes no side effect when applied in excessive amounts, including salts of fatty acids such as stearic acid, oleic acid, palmitic acid, caprylic acid, linolenic acid, and co-linolenic acid, such as barium stearate, iron stearate, nickel stearate, cobalt stearate, copper stearate, strontium stearate, calcium stearate, zinc oleate, barium oleate, lead oleate, zinc palmitate, barium palmitate, lead palmitate, etc. Other examples include natural waxes, such as candelilla wax, carnauba wax, rice wax, Japan wax, perilla oil, beeswax, and lanolin, which may be used as organic solid lubricants compatible with toner particles.

With reference to FIG. 3B, the brush roller 15*a* has bristles $\mathbf{15}a_1$ formed by spirally winding a brush strip onto a metal core $\mathbf{15}a_2$. The shape of the bristles $\mathbf{15}a_1$ is straight, that is, perpendicular to the surface of the metal core $\mathbf{15}a_2$, which configuration is superior to a looped shape in terms of efficiency in delivering lubricant from one surface to another.

In the present embodiment, the bristles 15$a_1$ are of a conductive polyester with a length of 2.4±0.2 mm and a density of 50,000±5,000 fibers per square inch (F/in$^2$).

The length of the bristles 15$a_1$ may be in the range of approximately 0.2 to approximately 20 mm, and preferably in the range of approximately 0.5 to approximately 10 mm. Bristles longer than 20 mm would bend outward through use due to continuous frictional contact with the photoconductive surface, leading to reduced rubbing against the lubricant 15*b* and insufficient lubrication of the photoconductive surface, whereas bristles shorter than 2 mm would result in insufficient frictional contact with the solid lubricant 15*b* and the photoconductive drum 11.

Suitable material for the bristles 15$a_1$ includes fibers of resin, such as polyester, nylon, rayon, acrylic, vinylon, polyvinyl chloride, or the like, which may be blended with a conductive material such as carbon to increase electrical conductivity if required.

The density of the bristles 15$a_1$ may be in the range of approximately 20,000 to approximately 100,000 F/in$^2$.

With reference to FIG. 3C, the metering blade 15*d* bends along the photoconductive surface under a contact pressure ranging from approximately 10 to approximately 30 g/cm, and at a contact angle θ of the edge face of the blade 15*d* (indicated by a line A3) to a plane tangent to the photoconductive surface (indicated by a line A2) ranging from approximately 75 to approximately 90 degrees. A line A1 is an imaginary line drawn normal to the tangent plane A2.

As described above, the imaging system or process cartridge 10 according to this patent specification is provided with the two blades 14*a* and 15*d* dedicated to cleaning and lubricating the photoconductive drum 11, respectively. Provision of the dedicated blades ensures the cleaning device 14 and the lubricating device 15 to properly work, and proper lubrication on the photoconductive surface in turn reliably protects the blades 14*a* and 15*d* from abrasion and degradation.

In addition, the blades 14*a* and 15*d* as well as the photoconductive drum 11 have their surfaces lubricated with zinc stearate prior to installation in the image forming apparatus 1. This reduces the risk of insufficient lubrication and transient high frictional resistance on the photoconductive surface at startup when the process cartridge 10 and/or the lubricating device 15 in unused condition is initially operated.

With further reference to FIGS. 3A and 3B, a description is given of characteristic features of the lubrication system according to this patent specification.

As shown in FIG. 3B, the brush roller 15*a* according to this patent specification is provided, prior to installation, with a priming agent P uniformly applied to the bristles 15$a_1$ in unused condition. The priming agent P is prepared by mixing a lubricant with a powder, for example, a mixture of ingredients of the solid lubricant 15*b* and the toner T used in the development process. In the present embodiment, the priming agent P is based on zinc stearate and contains approximately 50% by weight of toner having a volume average particle size of approximately 5.8±0.5 μm and a cohesion of approximately 10% or less.

As shown FIG. 3A, when installed and operated, the brush roller 15*a* applies the priming agent P onto the photoconductive drum 11 immediately after startup or before supplying constant amounts of lubricant from the solid mass of lubricant 15*b*. Upon application to the photoconductive surface, the priming agent P moves to a contact portion where the photoconductive drum 11 contacts the metering blade 15*d*, thus preventing high friction between the photoconductive surface and the blade edge at initial startup after installation.

As mentioned, the lubricating device 15 is configured so that the bristled surface of the brush roller 15*a* moves in a direction opposite to the direction of movement of the photoconductive surface where the two surfaces contact and slide over each other. Such a configuration ensures reliable lubrication of the contact portion, wherein the brush roller 15*a* retains a certain amount of the priming agent P upstream of the sliding contact, from which constant amounts of the priming agent P are stably transferred downstream to the contact portion.

One beneficial feature of the priming agent P according to this patent specification is its even distribution in the contact portion.

Specifically, the priming agent P is distributed substantially evenly across the width of the metering blade 15*d*, i.e., in a direction that is perpendicular to the sheet of paper on which the FIG. 3A is drawn, so that no area within the contact portion remains unlubricated or insufficiently lubricated. The even distribution of the priming agent P is effected by combining the lubricant with the powder component which has a certain flowability to train lubricant particles traversely across the photoconductive drum. By contrast, initially applying pure lubricant to the clean photoconductive surface with a brand-new applicator would result in uneven distribution of the material and insufficient lubrication at the contact portion.

To ensure the even distribution of the priming agent P, it is desirable to set the cohesion of the powder component equal to or less than approximately 10%.

Another beneficial feature of the priming agent P is its capability to retain lubricant in the contact portion.

Specifically, the priming agent P remains in the contact portion for a certain period of time after application to the photoconductive surface. Such an effect is also due to the powder component having a certain particle size so as to retain the lubricant within the contact portion. By contrast, pure lubricant, if applied to the clean photoconductive surface with a brand-new applicator, would readily bypass and insufficiently lubricate the contact portion.

To effect good retention of lubricant in the contact portion, it is desirable to set the volume average particle size of the powder component equal to or greater than approximately 5 μm.

As mentioned, the priming agent P in the present embodiment is prepared by mixing lubricant with toner used in the developing process. Such a configuration is reasonable since the use of toner as the powder component does not disturb production, operation, or quality of the image forming apparatus.

However, the advantageous features of the priming agent P described above can be provided regardless of whether the powder material used is toner or not, as long as the material that is used has a cohesion equal to or less than approximately 10% and a volume average particle size equal to or greater than approximately 5 μm. It has been experimentally confirmed that a lubricant mixture prepared with a non-toner material having a volume average particle size and a cohesion in such ranges possesses equivalent priming performance as that prepared using toner. Also confirmed is that a non-toner material having volume average particle size of approximately 5 μm or greater is sufficient to provide the advantages of the priming agent P described above.

In addition, the powder component may constitute approximately 40% to approximately 95% by weight of the priming agent P. A too-low concentration of the powder component leads to lubricant readily passing through the contact portion and uneven distribution of lubricant along the width of contact portion, whereas a too-high concentration of the powder component results in insufficient lubrication and friction reduction in the contact portion.

Figure 4A:
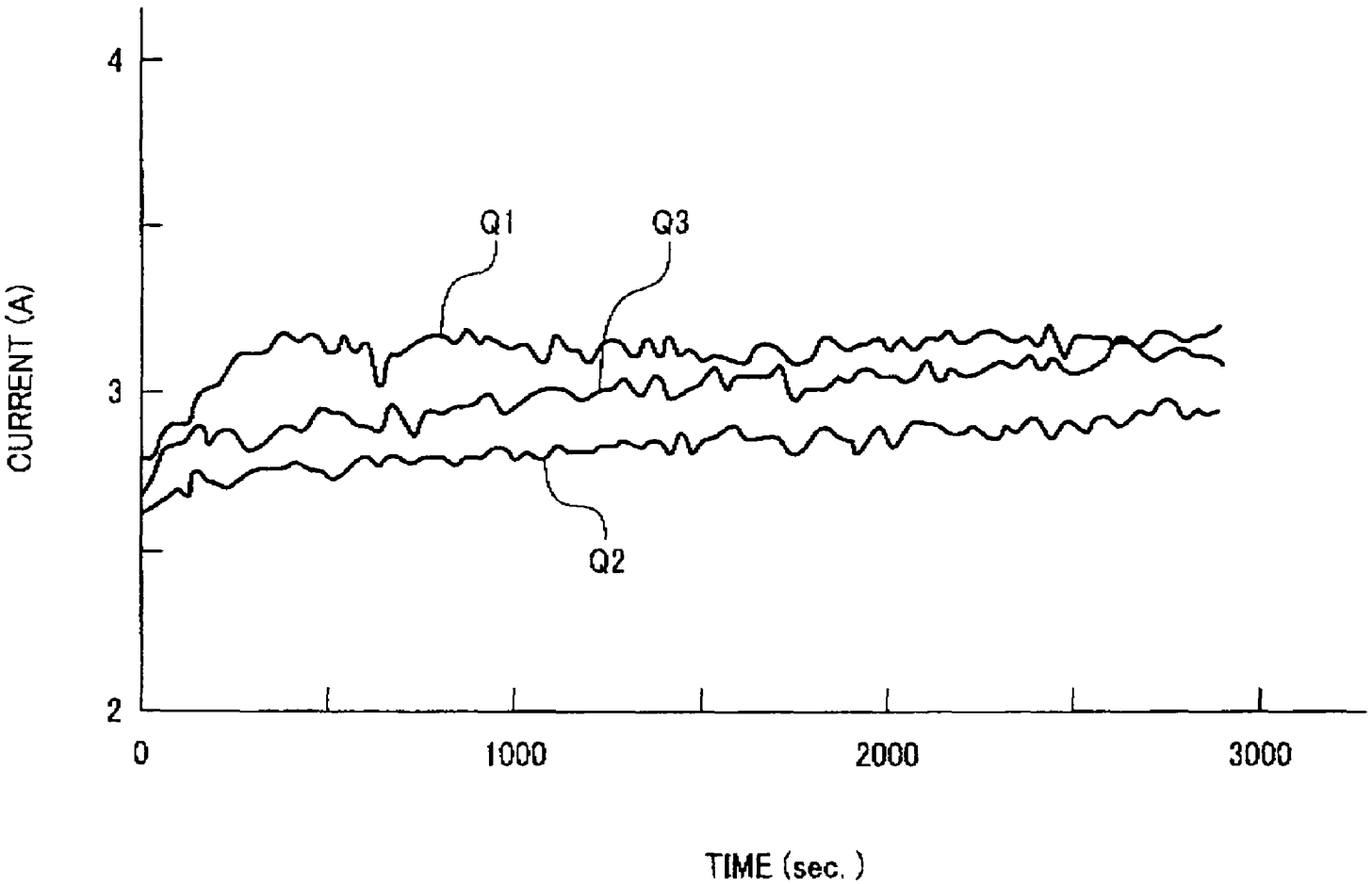
FIGS. 4A and 4B show results of tests conducted to demonstrate efficacy of a priming agent incorporated in the lubrication system.
Figure 4B:
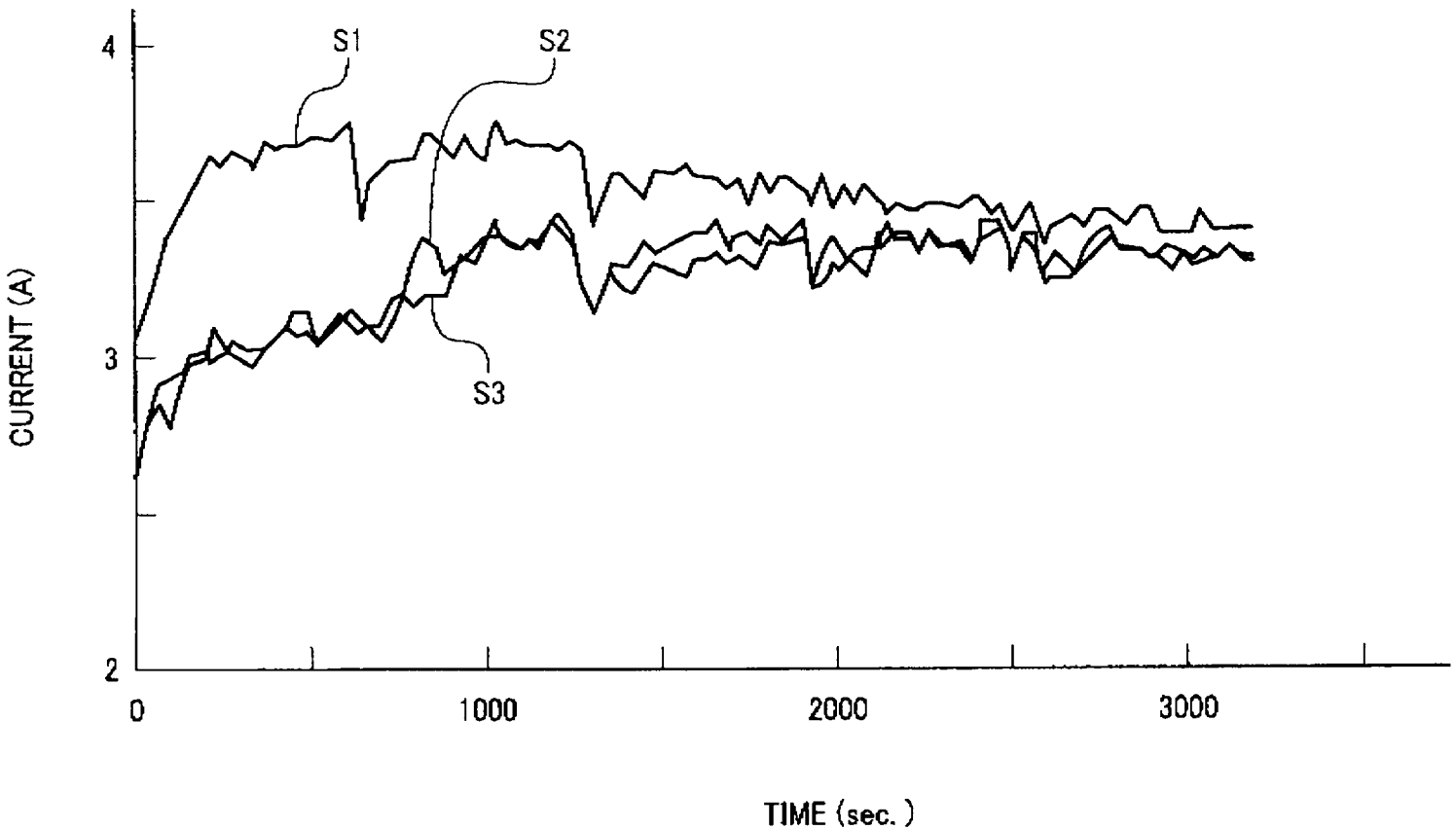

FIGS. 4A and 4B show results of tests conducted to demonstrate efficacy of the priming agent P compared to a pure lubricant in reducing frictional resistance between the photoconductive surface and the blade edge at initial startup.

In these tests, six brand-new brush rollers were coated with different amounts of materials, including samples Q1, Q2, and Q3 with 100 mg, 200 mg, and 300 mg, respectively, of the priming agent P formed of zinc stearate and toner, and comparison samples S1, S2, and S3 with 100 mg, 200 mg, and 300 mg, respectively, of pure lubricant formed of zinc stearate. Each brush roller was installed and operated in a lubricating device configured in a manner similar to that depicted in FIGS. 2A and 2B.

In FIGS. 4A and 4B, horizontal axis represents time in seconds elapsed since startup, and vertical axis represents current load in amperes on the motor driving the photoconductive drum. It is assumed that values along the load axis vary in proportion to the frictional resistance on the metering blade, that is, the higher the motor load, the greater the frictional resistance, and vice versa.

A comparison of the measurements for the samples Q1 through Q3 and those for the samples S1 through S3 proves the superiority of the priming agent P over the pure lubricant in terms of promptness and consistency in reducing frictional resistance on the metering blade 15*d*. In addition, the measurements for the samples Q1 through Q3 indicate that the priming agent P provides good lubricating performance when used at a sufficiently high application rate, that is, at least 100 mg per brush roller, equivalent to an application rate of approximately 8 $\mu g/mm^2$ on the outer surface of the brush roller.

Considering this fact, the application rate of the priming agent P according to this patent specification is set in the range of approximately 8 to approximately 33 $\mu g/mm^2$ on the outer surface of the brush roller 15*a*, i.e., an imaginary continuous smooth cylindrical surface formed by the tips of the bristles $\mathbf{15}a_1$ of the brush roller 15*a*. An application rate lower than 8 $\mu g/mm^2$ would result in insufficient reduction in the frictional resistance on the metering blade 15*d*, while an application rate exceeding 33 $\mu g/mm^2$ would result in saturation of the contact portion, leading to the material bypassing the contact portion to interfere with the subsequent charging process.

Thus, the lubrication system according to this patent specification reliably prevents fracturing of the metering blade upon initial startup after installation by providing a brand-new lubricant applicator with the priming agent prepared by mixing lubricant and powder.

In the embodiment described above, the priming agent according to this patent specification is applied to a brand-new brush roller prior to installation. It is desirable to perform such preparatory application in the manufacturing process, since the brush roller 15*a* according to this patent specification may be provided as a replacement part for an existing imaging system. However, it is possible to provide the priming agent P by itself as a stand-alone product offered to prepare a brand-new lubricant applicator for installation in an imaging system on any suitable occasion.

Further, in the present embodiment, the cleaning device and the lubricating device, together with the photoconductive drum, the charging device, and the developing device, are integrated into a single unit with the process cartridge for detachable attachment to the image forming apparatus, which reduces size and facilitates maintenance of the imaging devices. Alternatively, such components may be configured as separate units each removably mountable in the image forming apparatus. In either case, the lubrication system according to this patent specification provides excellent lubricating performance as described herein.

Still further, while the developing device in the present embodiment uses a two-component developer, the lubrication system according to this patent specification may also be used in conjunction with a single-component development process.

Yet still further, it is appreciated that the lubrication system according to this patent specification may be applied to lubricate any imaging surface other than a photoconductive drum, such as a photoconductive belt or an intermediate transfer belt, used to carry electrophotographic toner images thereon.

Numerous additional modifications and variations are possible in light of the above teachings. It is therefore to be understood that, within the scope of the appended claims, the disclosure of this patent specification may be practiced otherwise than as specifically described herein.

What is claimed is:

1. A lubricating device to lubricate a moving imaging surface subsequent to removal of residual toner by a cleaning device, the lubricating device comprising:

a lubricant applicator located downstream of the cleaning device in a direction of movement of the imaging surface, and configured to apply lubricant to the imaging surface;

a metering blade located downstream of the lubricant applicator in the direction of movement of the imaging surface, and configured to spread the applied lubricant into a thin layer by directly contacting the imaging surface; and a priming agent prepared by mixing a lubricant and a powder, and provided, prior to initial operation, on the lubricant applicator for application to the imaging surface upon startup.

2. The lubricating device according to claim 1, wherein the powder has a volume average particle size equal to or greater than approximately 5 μm and a cohesion equal to or less than approximately 10%.

3. The lubricating device according to claim 1, wherein the powder constitutes equals approximately 40% to approximately 95% by weight of the priming agent.

4. The lubricating device according to claim 1, wherein the priming agent is applied to an outer surface of the lubricant applicator at a rate ranging from approximately 8 to approximately 33 $\mu g/mm^2$.

5. The lubricating device according to claim 1, wherein the lubricant applicator is a brush roller having a straight-bristled outer surface held in sliding contact with the imaging surface and with a solid lubricant, respectively, and the priming agent is applied to the bristled surface prior to initial operation.

6. The lubricating device according to claim 5, wherein the brush roller and the imaging surface rotate in identical directions while in sliding contact with each other.

7. A process cartridge, comprising:

a movable imaging surface;

a cleaning device configured to remove residual toner from the imaging surface; and the lubricating device according to claim 1, the imaging surface, the cleaning device, and the lubricating device being integrally mounted as a single unit for detachable attachment to an image forming apparatus.

8. An image forming apparatus, comprising a movable imaging surface;

a cleaning device configured to remove residual toner from the imaging surface; and the lubricating device according to claim 1.

9. The lubricating device according to claim 1, wherein the powder is a toner.

10. A lubricant applicator to apply lubricant to a moving imaging surface downstream of a cleaning device and upstream of a metering blade in a direction of movement of the imaging surface, the cleaning device removing residual toner from the imaging surface, the metering blade spreading the applied lubricant into a thin layer by directly contacting the imaging surface, the lubricant applicator comprising:

a priming agent prepared by mixing a lubricant and a powder, and provided, prior to initial operation, on the lubricant applicator for application to the imaging surface upon startup.

11. The lubricant applicator according to claim 10, wherein the powder has a volume average particle size equal to or greater than approximately 5 μm and a cohesion equal to or less than approximately 10%.

12. The lubricant applicator according to claim 10, wherein the powder equals approximately 40% to approximately 95% by weight of the priming agent.

13. The lubricant applicator according to claim 10, wherein the priming agent is applied to an outer surface of the lubricant applicator at a rate ranging from approximately 8 to approximately 33 $\mu g/mm^2$.

14. The lubricant applicator according to claim 10, wherein the lubricant applicator is a brush roller having a straight-bristled outer surface held in sliding contact with the imaging surface and with a solid lubricant, respectively, and the priming agent is applied to the bristled surface prior to initial operation.

15. The lubricant applicator according to claim 10, wherein the powder is a toner.

16. A method of applying a priming agent for use with a lubricant applicator, comprising:

applying the priming agent prepared by mixing a lubricant and a powder on the lubricant applicator prior to initial operation;

applying the lubricant applicator with the priming agent onto a movable imaging surface downstream of a cleaning device and upstream of a metering blade in a direction of movement of the imaging surface upon startup;

removing residual toner with the cleaning device from the imaging surface; and spreading the applied priming agent with the metering blade into a thin layer by directly contacting the imaging surface.

17. The method of applying a priming agent according to claim 16, wherein the powder has a volume average particle size equal to or greater than approximately 5 μm and a cohesion equal to or less than approximately 10%.

18. The method of applying a priming agent according to claim 16, wherein the powder equals approximately 40% to approximately 95% by weight of the priming agent.

19. The method of applying a priming agent according to claim 16, wherein the powder is a toner.

* * * * *